US007782354B2

(12) United States Patent
Yamazaki

(10) Patent No.: US 7,782,354 B2
(45) Date of Patent: Aug. 24, 2010

(54) OPTICAL WRITING DEVICE AND IMAGE FORMING APPARATUS

(75) Inventor: Kozo Yamazaki, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 7 days.

(21) Appl. No.: 12/073,312

(22) Filed: Mar. 4, 2008

(65) Prior Publication Data

US 2008/0219704 A1 Sep. 11, 2008

(30) Foreign Application Priority Data

Mar. 5, 2007 (JP) ..... 2007-054854

(51) Int. Cl.
*B41J 15/14* (2006.01)
*B41J 27/00* (2006.01)

(52) U.S. Cl. ..... 347/242; 347/257

(58) Field of Classification Search ..... 347/137, 347/230, 241–245, 256–261, 263; 359/204, 359/204.1, 205.1
See application file for complete search history.

(56) References Cited

U.S. PATENT DOCUMENTS 5,365,259 A * 11/1994 Kanoto et al. ..... 347/137
5,581,392 A * 12/1996 Hayashi ..... 359/205.1
6,775,042 B2 * 8/2004 Ishihara ..... 359/204.1
7,215,349 B2 5/2007 Sakaue et al.
2004/0100550 A1 5/2004 Bannai et al.
2006/0055769 A1 3/2006 Yamazaki et al.
2007/0153079 A1 7/2007 Sakaue et al.
2007/0165099 A1 * 7/2007 Yoshizawa et al. ..... 347/245
2007/0211137 A1 9/2007 Yamazaki
2008/0130078 A1 * 6/2008 Okuwaki et al. ..... 359/204

FOREIGN PATENT DOCUMENTS

JP 05-027189 2/1993
JP 05027189 A * 2/1993
JP 10-206770 8/1998
JP 2001-228431 8/2001
JP 2005-091714 4/2005
JP 2006-184622 7/2006
JP 2006184622 A * 7/2006

* cited by examiner

*Primary Examiner*—Hai C Pham
(74) *Attorney, Agent, or Firm*—Harness, Dickey & Pierce, P.L.C.

(57) ABSTRACT

An electrophotographic optical writing device equipped with a semiconductor laser includes the semiconductor laser, a collimating lens, an aperture, a cylindrical lens, and a polygon scanner. An additional aperture, a second aperture, is provided in a light path between the semiconductor laser and the collimating lens.

11 Claims, 3 Drawing Sheets

OPTICAL WRITING DEVICE AND IMAGE FORMING APPARATUS

CROSS-REFERENCE TO RELATED APPLICATIONS

The present application claims priority to and incorporates by reference the entire contents of Japanese priority document, 2007-054854 filed in Japan on Mar. 5, 2007.

BACKGROUND OF THE INVENTION

1. Field of the Invention

The present invention relates to an optical writing device used in an image forming apparatus.

2. Description of the Related Art

An optical writing device is used in image forming apparatuses, such as digital copying machines and laser printers, and optical printing devices, to form a latent image on an image carrying member. Because laser printers and digital copying machines that can produce high-quality images, operate at high speed, occupy less space, are able to contribute to energy conservation, and have low manufacturing costs etc. are in demand, it is preferable that optical systems used in optical writing device of such laser printers and digital copying machines have high performance and low costs.

Costs can be reduced by reducing the number of components. Another approach to reduce the costs is to fix optical elements (lens, mirror etc.) to a housing using an adhesive, i.e., without using dedicated fixing component.

Japanese Patent Application Laid-open No. 2005-091714 discloses an optical writing device in which a component that blocks unwanted light produced because of the adhesive layer of a collimating lens is arranged in a lens holder that is located immediately after the collimating lens.

In existing technologies, a divergent laser beam emitted by a semiconductor laser is collimated by using a collimating lens. If the collimating lens is smaller, the laser beam immerging from near a periphery of the lens gets mixed with a main laser beam and it cannot be separated in a light path beyond the collimating lens. If the laser beam immerging from near the periphery of the lens gets mixed with the main laser beam, a ghost image can occur.

SUMMARY OF THE INVENTION

It is an object of the present invention to at least partially solve the problems in the conventional technology.

According to an aspect of the present invention, there is provided an optical writing device, which employs an electrophotographic method to form an image, including a semiconductor laser, a collimating lens, an aperture, a cylindrical lens, and an optical deflector, and a housing that houses the semiconductor laser, the collimating lens, the aperture, the, cylindrical lens, and the optical deflector, and the collimating lens and the cylindrical lens are fixed to the housing with an adhesive. The optical writing device further includes a second aperture arranged in a light path between the semiconductor laser and the collimating lens.

According to an aspect of the present invention, there is provided an image forming apparatus comprising an optical writing device that electrophotographically forms a latent image on a surface to be scanned. The optical writing device includes a semiconductor laser, a collimating lens, an aperture, a cylindrical lens, and an optical deflector, and a housing that houses the semiconductor laser, the collimating lens, the aperture, the cylindrical lens, and the optical deflector, and the collimating lens and the cylindrical lens are fixed to the housing with an adhesive. The optical writing device further includes a second aperture arranged in a light path between the semiconductor laser and the collimating lens.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
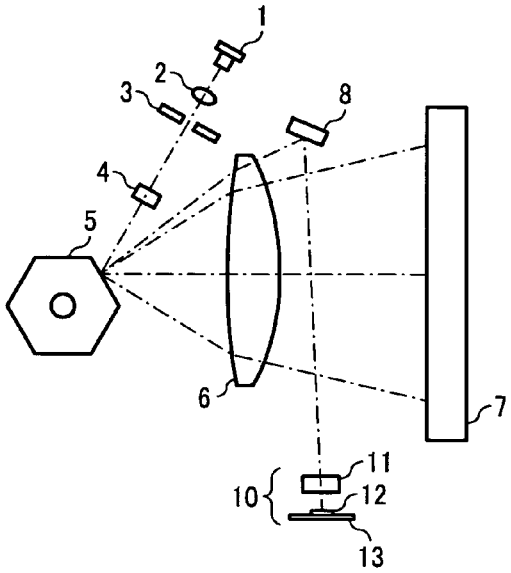
FIG. 1 is a schematic of an optical writing device according to an embodiment of the present invention in a main-scanning plan.

Exemplary embodiments of the present invention are explained below with reference to the accompanying drawings. FIG. 1 is a schematic view of an optical writing device according to an embodiment of the present invention in a main-scanning plan.

A laser beam emitted by a semiconductor laser 1, which oscillates the laser beam, passes through a collimating lens 2, undergoes beam shaping by an aperture 3, and falls on a cylindrical lens 4 that serves as a linear imaging optical system.

The cylindrical lens 4 has refractive power in a sub-scanning direction and converges the laser beam close to a reflective surface of a polygon mirror (optical deflector) 5.

The polygon mirror 5 is made to rotate at a constant speed. Because of the rotation of the polygon mirror 5, the laser beam is deflected with a uniform angular speed, passes through a scanning lens 6, and finally reaches a photosensitive member 7. Although not shown, one or more mirrors are arranged in a light path between the optical deflector 5 and the photosensitive member 7 as required.

A portion of the laser beam between the scanning lens 6 and the photosensitive member 7 is reflected by a mirror 8 toward a synchronous detector 10.

The synchronous detector 10 obtains a synchronous signal from this laser beam. The synchronous detector 10 includes a lens 11, a light receiving element 12, and a synchronous detection unit (signal-generating circuit board) 13.

Figure 2:
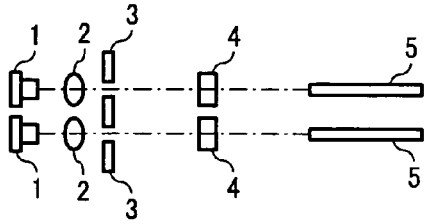
FIG. 2 is a schematic of components of the optical writing device shown in FIG. 1 from a light source to an optical deflector in a sub-scanning direction.

FIG. 2 is a schematic of the components from the semiconductor laser 1 to the optical deflector 5 in the sub-scanning direction.

The example shown in FIG. 2 includes a pair each of the semiconductor lasers 1, the collimating lenses 2, the apertures 3, the cylindrical lenses 4, and the polygon mirrors 5. The components from the semiconductor lasers 1 to the cylindrical lenses 4 are arranged one above the other sandwiching the floor of a housing.

Scanning surfaces from the polygon mirror 5 onwards are arranged one above the other in two steps, similar to the light guiding components arranged before the polygon mirror 5 as shown in FIG. 2.

Figure 3:
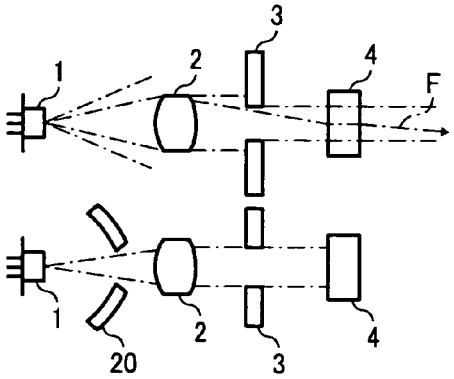
FIG. 3 is a schematic of components of an optical writing device according to a first embodiment of the present invention from a light source to a cylindrical lens in a sub-scanning direction.

FIG. 3 is a schematic of components of an optical writing device according to a first embodiment of the present invention from a light source to a cylindrical lens in a sub-scanning direction. In the optical writing device according to the first embodiment, a second aperture 20 is provided between the semiconductor laser 1 and the collimating lens 2 such that the laser beam emitted from the semiconductor laser 1 passes through the second aperture 20 before falling on the collimating lens 2. Thus, the second aperture 20 blocks the light which would otherwise form unwanted light F after passing through the collimating lens 2. The second aperture 20 is provided such that the aperture walls are disposed on either side of a main laser beam in a main scanning direction.

The collimating lens 2 is fixed by using an adhesive material. The fastening process includes holding the collimating lens 2 in place, coating an adhesive, exposing the adhesive to light to harden it, etc. Therefore, it is necessary to leave enough space around the lens to operate an adhesive jig.

Figure 6:
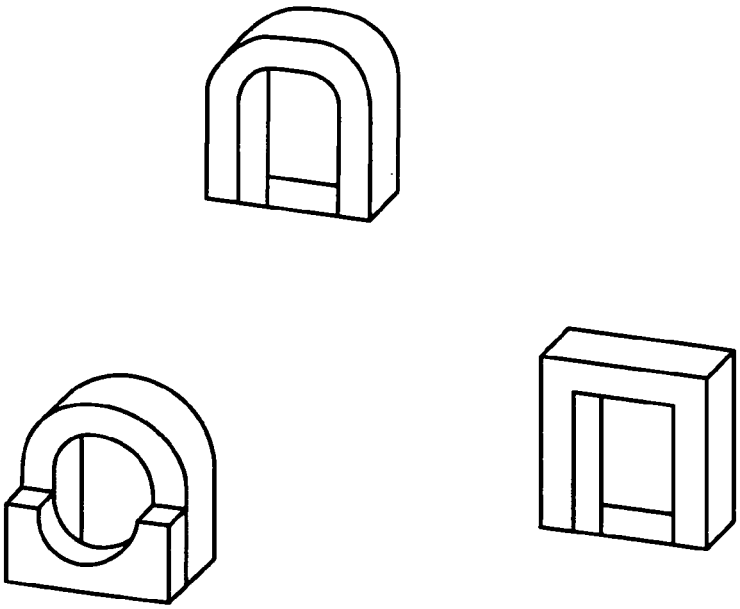
FIG. 6 are perspectives of second apertures that are integrated with an housing.

The second aperture 20 can be molded integrally with the housing as shown in FIG. 6. In this case, the second aperture 20 is provided within the space secured for operating the adhesive jig.

Figure 5:
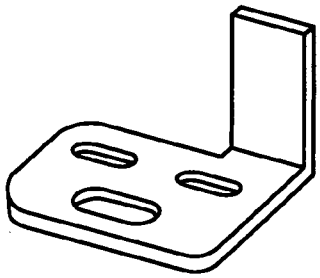
FIG. 5 is a perspective of a second aperture that is formed as separate component.

Alternatively, if there is no sufficient space for the adhesive jig so that the second aperture 20 needs to be shifted closer to the collimating lens 2, then the second aperture 20 is provided as a separate component as shown in FIG. 5 and it is attached to the collimating lens 2 with an adhesive.

The second aperture 20 is an opening with one wall (either on the left side or on the right side), two walls (on the left side as well as the right sides), three walls (on the left side, right side, and above (that is, on the side opposite to the fastening side)) or four walls (on the left side, right side, above, and below) around the main laser beam. The shape of the aperture depends on various factors such as focal length, number of apertures, and outer diameter of the collimating lens 2, and relative position of the collimating lens 2 and the semiconductor laser 1.

A three-walled or a four-walled second aperture 20 is formed as a rectangular shape.

The shape of the aperture can be made circular, reverse U if the fastening side is disregarded, or elliptical, to match the shape of the collimating lens 2. Consequently, unwanted light from not only the right side and left side of the collimating lens 2 but from all around the periphery of the collimating lens 2 can be blocked.

The dimensional tolerance for the position of the light-blocking wall can be very narrow depending on the arrangement and performance efficiency of the semiconductor laser 1, the collimating lens 2, the aperture 3, the cylindrical lens 4, the polygon mirror 5, and other optical elements thereafter. Therefore, the position of the light-blocking member can be determined by measuring the laser power of the unwanted light. Added advantage to this method in that, one can confirm if at all there is presence of unwanted light and therefore a need for the light-blocking member.

Figure 4:
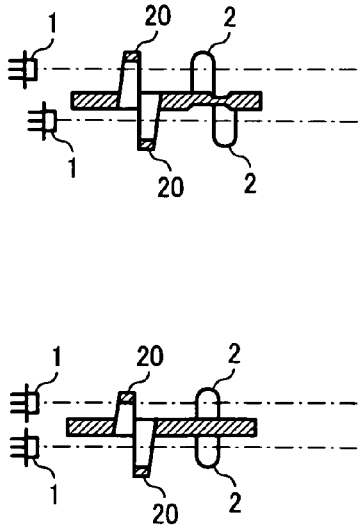
FIG. 4 is a schematic of components of an optical writing device according to a second embodiment of the present invention from a light source to a collimating lens in a sub-scanning direction.

The light-blocking wall can be molded integrally with the housing. In an optical writing device in which the scanning surfaces are in two steps, one second aperture 20 is provided on either side of the floor of the housing. However, when manufacturing without upper and lower scanning surfaces, the walls cannot be disposed at the same position and are therefore staggered along the optical axis as shown in FIG. 4. There are two ways in which the optical elements can be arranged. The layout of the optical elements can be kept unchanged with only the positions of the wall staggered. Alternatively, the layout of the optical elements can be staggered so that the distance between the position of the wall and the collimating lens 2 on either side is the same.

According to the embodiments of the present invention, a laser beam immerging from near the periphery of the lens is prevented from getting mixed with the main laser beam, so that ghost images can be prevented from appearing.

Figure 7:
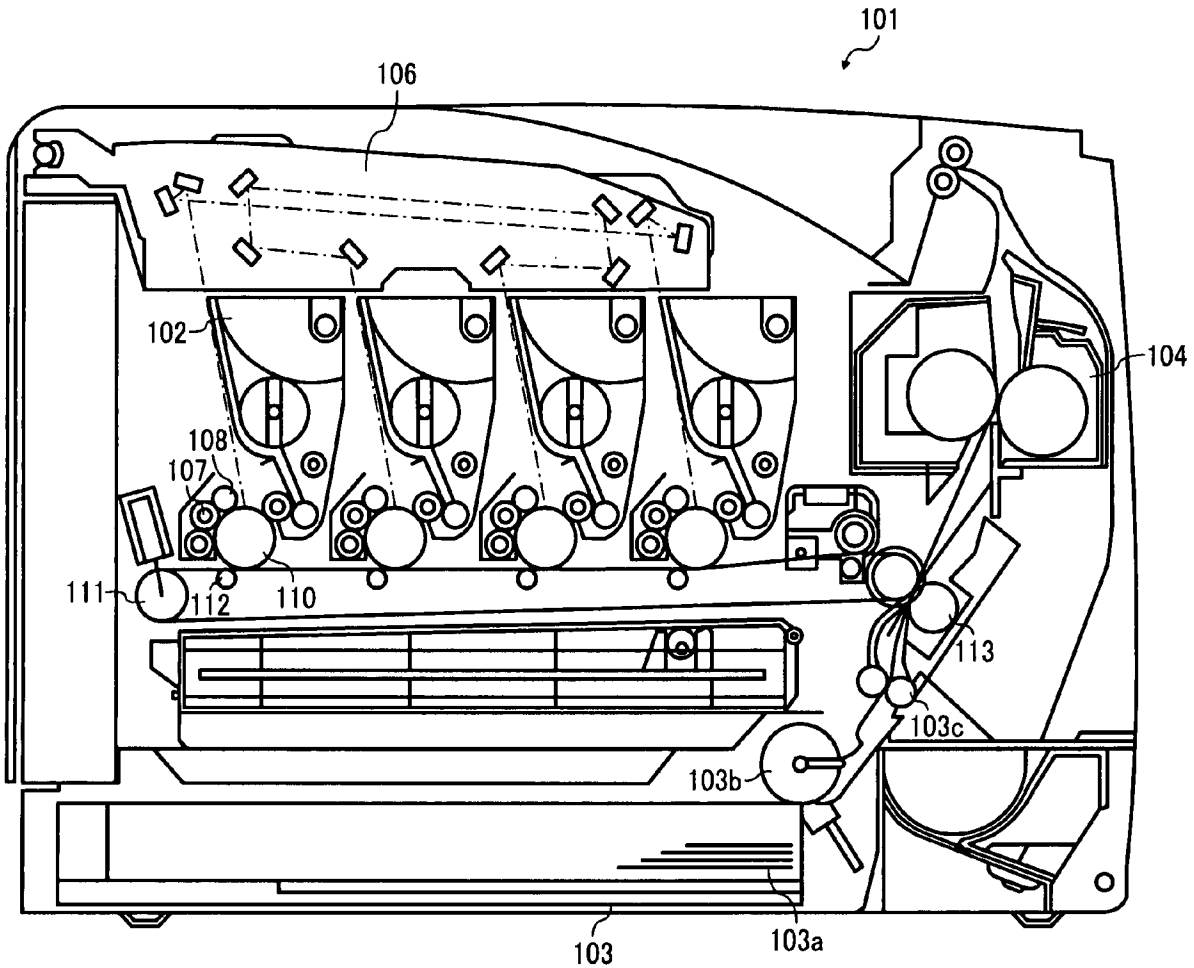
FIG. 7 is a schematic depicting an internal structure of an image forming apparatus according a third embodiment of the present invention.

FIG. 7 depicts an internal structure of an image forming apparatus 101 according to a third embodiment of the present invention that is equipped with the optical writing device explained above. In the image forming apparatus 101, around each of a plurality of photosensitive drums 110 are arranged a charging unit 108, an exposure unit (optical writing device) 106, a developing unit 102, transfer units 112 and 113, and a cleaning unit 107, respectively, sequentially in the direction of rotation of the photosensitive drum 110.

The charging unit 108 is a conductive roller. A charging bias voltage is supplied to the charging unit 108 from a power supply unit and the surface of the photosensitive drum 110 is uniformly charged.

Based on image data, the exposure unit (optical writing device) 106 exposes the surface of the photosensitive drum 110 by intermittently emitting laser beam and creates an electrostatic latent image on the photosensitive drum 110.

The developing unit 102 develops the electrostatic latent image created on the photosensitive drum 110 into a visible image using a developer.

The transfer unit 112 transfers the visible image from the photosensitive drum 110.

The cleaning unit 107 removes the residual developer from the surface of the photosensitive drum 110 after image transfer.

In FIG. 7, a structure is shown in which on transferring the images on a plurality of photosensitive drums 110 to each intermediate transfer unit 111, the images are transferred to transfer sheets 103*a* by the transfer unit 113. The transfer sheets 103*a* are separated by a roller 103*b* of a paper feeding unit 103 and fed to a resist roller 103*c* one at a time, and further fed to the transfer unit 113.

According to an aspect of the present invention, in the optical writing device, unwanted light can be blocked using a simple structure.

Moreover, unwanted light can be blocked even in the optical writing device in which opposing scanning is performed on either side of the polygon scanner.

Moreover, unwanted light coming from above can also be blocked.

Moreover, unwanted light coming from all directions can be blocked by matching the shape of aperture with that of a collimating lens.

Moreover, the number of components can be reduced by forming the second aperture integrally with the housing.

Moreover, a housing that includes scanning surfaces arranged in two steps can be integrally molded.

Moreover, a high quality image can be realized due to being equipped with the optical writing device that blocks light in the manner described above.

Although the invention has been described with respect to preferred embodiments, the present invention allows various other modifications which fairly fall within the basic teaching herein set forth.

According to the present invention, unwanted light produced by a collimating lens directly fixed to a housing with an adhesive can be blocked.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device, which employs an electrophotographic method to form an image, the optical writing device comprising:

a semiconductor laser;

a collimating lens;

a first aperture forming member including a first aperture;

a cylindrical lens;

an optical deflector;

a housing that houses the semiconductor laser, the collimating lens, the first aperture forming member, the cylindrical lens, and the optical deflector, and the collimating lens and the cylindrical lens are fixed to the housing with an adhesive; and a second aperture forming member including a second aperture arranged in a light path between the semiconductor laser and the collimating lens, wherein the second aperture forming member is molded integrally with the housing, and the optical deflector includes scanning surfaces that are arranged in two steps separated vertically and sandwiching a floor of the housing, and the second aperture forming member includes two second apertures, one second aperture corresponding to each scanning surface, and the two second apertures are staggered in relation to each other in a light path of the optical writing device.

2. The optical writing device according to claim 1, wherein the second aperture forming member is a wall disposed on one side of a main beam in a main scanning direction in the light path between the semiconductor laser and the collimating lens.

3. The optical writing device according to claim 2, wherein the semiconductor laser includes two semiconductor lasers, one semiconductor laser corresponding to each scanning surface, the collimating lens includes two collimating lenses, one collimating lens corresponding to each scanning surface, and the two semiconductor lasers, the two collimating lenses, and the two second apertures are staggered in relation to each other on the light path.

4. The optical writing device according to claim 1, wherein the second aperture forming member is a wall disposed on either side of the main beam in the main scanning direction in the light path between the semiconductor laser and the collimating lens.

5. The optical writing device according to claim 4, wherein the semiconductor laser includes two semiconductor lasers, one semiconductor laser corresponding to each scanning surface, the collimating lens includes two collimating lenses, one collimating lens corresponding to each scanning surface, and the two semiconductor lasers, the two collimating lenses, and the two second apertures are staggered in relation to each other on the light path.

6. The optical writing device according to claim 1, wherein the second aperture forming member is a rectangular wall.

7. The optical writing device according to claim 6, wherein the semiconductor laser includes two semiconductor lasers, one semiconductor laser corresponding to each scanning surface, the collimating lens includes two collimating lenses, one collimating lens corresponding to each scanning surface, and the two semiconductor lasers, the two collimating lenses, and the two second apertures are staggered in relation to each other on the light path.

8. The optical writing device according to claim 1, wherein the second aperture forming member is one of a circular wall and an elliptical wall.

9. The optical writing device according to claim 8, wherein the semiconductor laser includes two semiconductor lasers, one semiconductor laser corresponding to each scanning surface, the collimating lens includes two collimating lenses, one collimating lens corresponding to each scanning surface, and the two semiconductor lasers, the two collimating lenses, and the two second apertures are staggered in relation to each other on the light path.

10. The optical writing device according to claim 1, wherein the semiconductor laser includes two semiconductor lasers, one semiconductor laser corresponding to each scanning surface, the collimating lens includes two collimating lenses, one collimating lens corresponding to each scanning surface, and the two semiconductor lasers, the two collimating lenses, and the two second apertures are staggered in relation to each other on the light path.

11. An image forming apparatus including an optical writing device that electrophotographically forms a latent image on a surface to be scanned, the optical writing device comprising:

a semiconductor laser;

a collimating lens;

a first aperture forming member including a first aperture;

a cylindrical lens;

an optical deflector; and a housing that houses the semiconductor laser, the collimating lens, the first aperture forming member, the cylindrical lens, and the optical deflector, wherein the collimating lens and the cylindrical lens are fixed to the housing with an adhesive, and the optical writing device further includes a second aperture forming member including a second aperture arranged in a light path between the semiconductor laser and the collimating lens, wherein the second aperture forming member is molded integrally with the housing, and the optical deflector includes scanning surfaces that are arranged in two steps separated vertically and sandwiching a floor of the housing, and the second aperture forming member includes two second apertures, one second aperture corresponding to each scanning surface, and the two second apertures are staggered in relation to each other in a light path of the optical writing device.

* * * * *